United States Patent [19]

Momot et al.

[11] Patent Number: 4,709,634

[45] Date of Patent: Dec. 1, 1987

[54] PLATE CYLINDER REGISTER CONTROL

[75] Inventors: Stanley Momot, La Grange; William G. Hannon, Westchester, both of Ill.

[73] Assignee: Rockwell International Corporation, Pittsburgh, Pa.

[21] Appl. No.: 914,430

[22] Filed: Oct. 2, 1986

[51] Int. Cl.[4] ..... B41F 13/12

[52] U.S. Cl. ..... 101/248; 101/181

[58] Field of Search ..... 101/248, DIG. 12, 181, 101/183, 184, 221

[56] References Cited

U.S. PATENT DOCUMENTS

| | | | |
|---|---|---|---|
| 1,745,467 | 2/1930 | Barber | 101/248 |
| 1,850,800 | 3/1932 | Langston et al. | 101/183 X |
| 2,372,783 | 4/1945 | Jacobson | 101/183 X |
| 2,425,914 | 8/1947 | Blackley et al. | 101/248 |
| 2,775,935 | 1/1957 | Reinartz et al. | 101/248 |
| 3,505,953 | 4/1970 | Germann | 101/248 |

FOREIGN PATENT DOCUMENTS

| | | | |
|---|---|---|---|
| 1385941 | 3/1975 | United Kingdom | 101/248 |

*Primary Examiner*—Charles A. Pearson

[57] ABSTRACT

A printing press sidelay and circumferential register mechanism having cooperating elongated operator elements which are rotatably driven by remotely controlled motors to laterally and circumferentially adjust the position of the plate cylinder through thrust bearings that support the ends of the operator elements adjacent the end of the plate cylinder.

6 Claims, 3 Drawing Figures

PLATE CYLINDER REGISTER CONTROL

BACKGROUND OF THE INVENTION

It is common practice in modern day web fed printing to have the web pass through a plurality of printing stands and to perform a printing function at each stand. This is true, for example, in an operation where multiple colors are being printed on the traveling web. In situations such as the multiple-color printing mentioned, it is obviously necessary that each successive area where printing is to be effected be precisely located so that it falls within the predesignated area on the web. This positioning requirement obviously means that the plates on the plate rolls in the successive printing stands must be in precise, predetermined locations with respect to both lateral and circumferential positions. When proper alignment is attained, the printing plates are referred to as being in register.

The problem of placing printing plates in register is one that has been recognized in the graphic arts industry for many years. As a problem of long standing, it should be apparent that it has been the subject of a variety of solutions, which solutions have attained various degrees of effectiveness. Generally speaking, prior art mechanisms for seeking registration have involved two separate adjustment mechanisms, the circumferential adjusting device being on the drive side of the press and the side-lay or lateral adjusting device being on the operating side of the press. Adjustment was usually effected by means of hand-wheels and screw threads and/or gearing. Devices for adjusting circumferential or lateral register, or both, which are representative of those in the prior art can be seen in U.S. Pat. Nos. 2,566,399; 3,717,092; 4,137,845; 4,207,815 and 4,336,755.

SUMMARY OF THE INVENTION

It is a principal object of this invention to provide an improved mechanism for effecting both lateral and circumferential registry of printing plates on a plate cylinder which is positioned on one side only of the press.

Another object of this invention is to provide an improved press register mechanism in which adjustment in lateral and circumferential directions can be effected by remote means.

An additional object of this invention is to provide a unitary mechanism for effecting both lateral and circumferential register adjustment in a printing press.

These and other objects and advantages of this invention will be in part obvious and in part explained by reference to the accompanying specification and drawings, in which:

DESCRIPTION OF THE INVENTION

Figure 1:
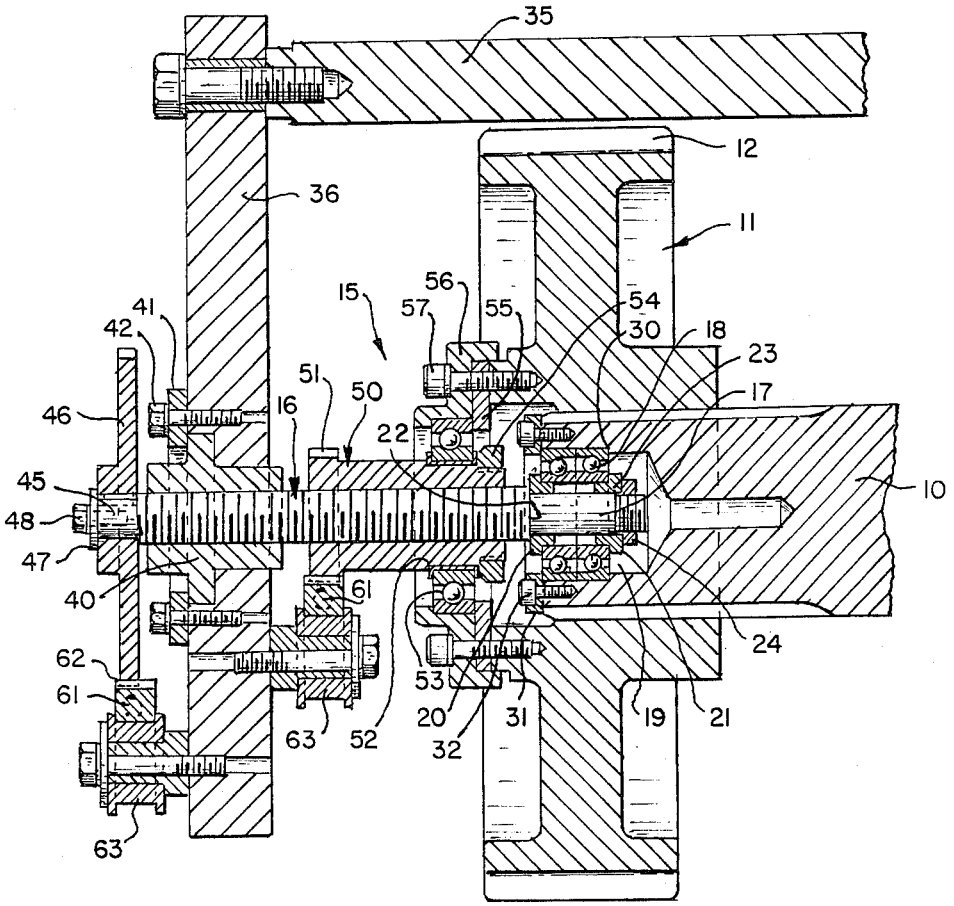
FIG. 1 is a cross sectional view through the register adjusting mechanism of this invention, showing some parts in full.

The present invention, as already mentioned, is utilized in connection with a rotary printing press in which printing is to be performed on the web at more than one location, such as when multiple colors are to be applied to the traveling web. In these presses, the plate cylinders must be adjusted both laterally and circumferentially to ensure that the plates mounted thereon are brought into proper register. To more fully understand the present invention, reference is made to the drawings, and more particularly to FIG. 1. In this figure numeral 10 represents the journal on one end of the plate cylinder, the plate cylinder not being shown. The journal 10 as well as the journal on the other end of the plate cylinder are supported by means of the press frames, (which are also not shown). Journal 10 has the main cylinder drive gear 11 mounted on its outer end and gear 11 is formed with appropriate teeth 12 that are driven by a drive motor.

The lateral and circumferential register adjusting mechanism is indicated generally by the numeral 15 and comprises a part which effects lateral or side lay register and a part which is responsible for effecting circumferential register of the printing plates. Central to the operation of register mechanism 15 is an elongated operator means 16 which takes the form of an elongated shaft having external threads on its outer surface. This shaft 16 is directly responsible for effecting side lay register and indirectly responsible for assisting in the adjustment of circumferential register.

As can be seen, the first or inner end of shaft member 16 has a shoulder 17 that is contained within a thrust bearing 18 held in bore 19, which is formed in the end of plate cylinder journal 10. The inner race of bearing 18 is retained on shoulder 17 by means of a pair of mounting rings 20 and 21, the ring 20 abutting against the ledge 22 formed on the elongated shaft 16. The other ring 21 is retained against the bearing race by means of a washer 23 and a nut 24 that are secured to the elongated shaft member 16.

The outer race of thrust bearing 18 is mounted between a shoulder 30 which is formed in the bore 19 and an outer locking ring 31 that is secured to the end face of journal 10 by means of threaded fasteners 32.

The other end of elongated shaft 16 is supported by means of supporting bracket 35 which is connected to the press side wall and extends outwardly therefrom to terminate in a downwardly extending plate-like support element 36. The externally threaded surface of elongated shaft 16 is received into an internally threaded side-lay nut 40 that is disposed within an opening formed in the supporting plate 36. Side lay nut 40 is received into an appropriate recess in 36 and held in position by means of retaining ring 41 and threaded fasteners 42.

Elongated shaft member 16 has a second shoulder 45 formed on its second end, that is the end located furthest away from the plate drive gear 12. On this shoulder there is disposed a sprocket-like drive gear 46 that is retained in position on the second shoulder 45 by means of a washer 47 and a threaded fastener 48 that is received onto the outer end of the shaft 16. The purpose of the sprocket 46 is to interconnect the shaft 16 with an appropriate driving source that can effect rotation of the shaft 16.

There is mounted on the threaded outer surface of elongated shaft 16, intermediate the shoulders 17 and 45, an internally threaded sleeve 50 that is used to effect circumferential register of the plate cylinder. Sleeve 50 has on the end located furthest away from drive gear 11, teeth 51 that are engaged by appropriate drive means (to be described) to cause rotation of sleeve 50 in one direction or another. The other end of sleeve 50, that is the end nearest to plate drive gear 11 has a shoulder 52 that receives a thrust bearing 53 that is retained in position by means of a locking ring 54. The thrust bearing 53 is held in position between lock ring 54 and an edge abutment which terminates at one end of the shoulder 52. The upper race of bearing 53 is held in position between clamping elements 55 and 56 and are retained in position by means of threaded fasteners 57 that extend directly into the drive gear 11.

Figure 2:
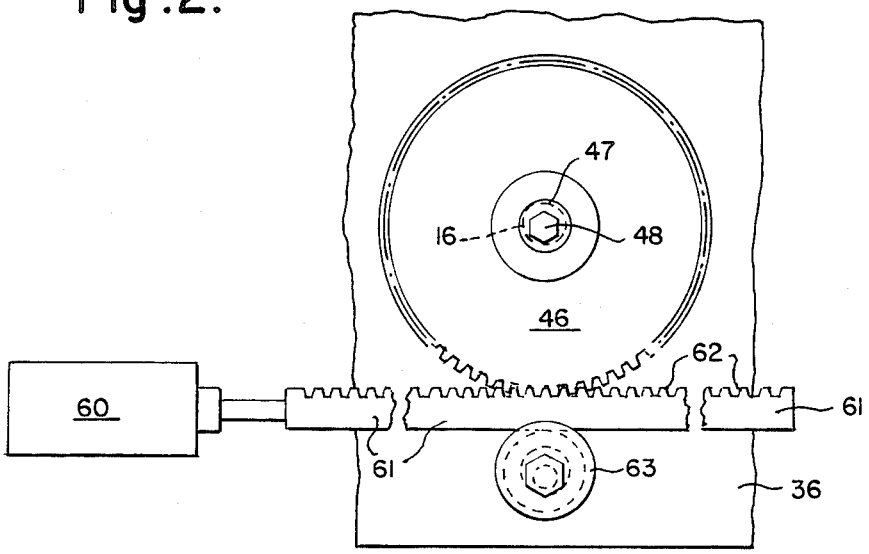
FIG. 2 is a view taken along the line 22 of FIG. 1.
Figure 3:
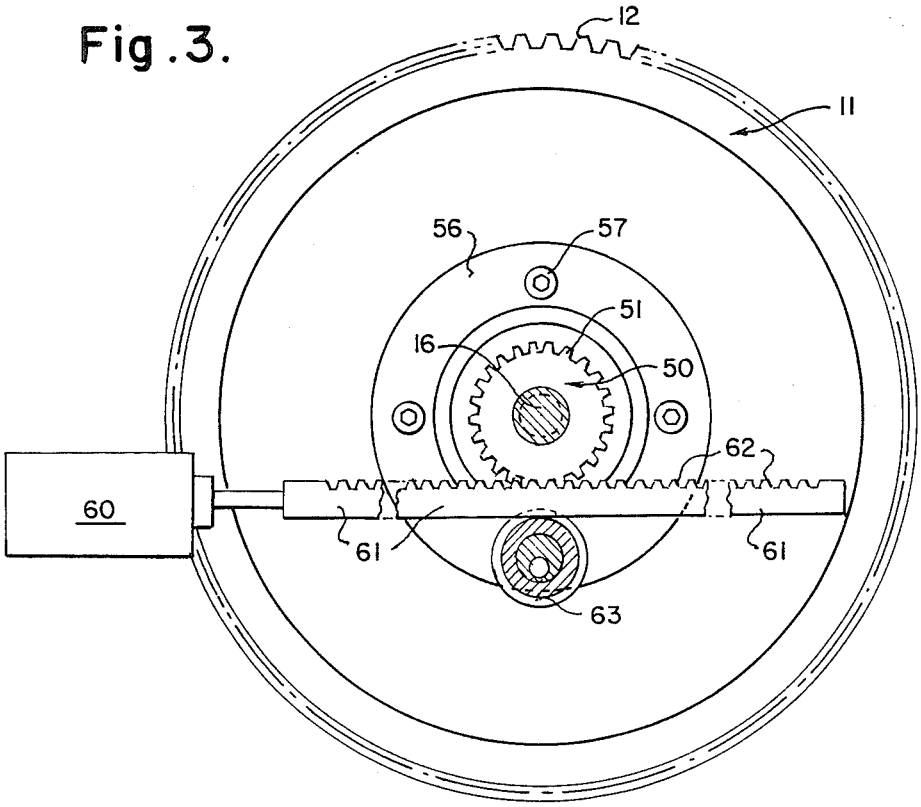
FIG. 3 is a view taken along the line 33 of FIG. 1.

The drive means utilized to effectuate rotation of shaft 16 and of side lay nut 50 is in each case a linear motor. Each linear motor is comprised of a rack which mates with either sprocket 46 or with the teeth 51 on sleeve 50. In the case of the sprocket 46 the drive means can best be seen in FIG. 2 of the drawings where the numeral 60 designates the means for effecting reciprocatory motion of the rack 61. The means 60 may be either an electric or hydraulic motor as desired. The teeth 62 shown on the rack 61 mesh with the teeth on the sprocket 46 and this in turn causes rotation of the elongated shaft 16. In FIG. 3 the same numerals are used with respect to the source of motor power and the rack that are shown in FIG. 2 of the drawings. In this instance however, the teeth 62 of rack 61 engage the teeth 51 of the sleeve 50 to effect rotation of this element. It will be noted in FIGS. 2 and 3 that in each instance a support roll 63 is used to provide stability against flexure of the rack.

In operation, to effect lateral or side lay adjustment of the plate roll, the source of motive power 60 is energized to move the rack 61 in the desired direction and thereby cause rotation of the sprocket 46. Rotation of the sprocket causes, in turn, rotation of elongated shaft 16 which by virtue of its threaded engagement with the internally threaded nut 40 tends to cause movement of shaft 16 and thereby creates an axial stress to be created within the shaft 16. This axial stress is transmitted through the thrust bearing 18 into the journal 10 of the plate cylinder and thereby causes a lateral shifting of the cylinder.

In the event that circumferential adjustment of the plate roll is desired, the source of power 60 for the rack that rotates sleeve member 50 is energized to cause rack 61 to cooperate with teeth 51 and turn the sleeve 50 in the required direction. Rotation of sleeve 50 causes the sleeve to move either toward or away from the cylinder drive gear and create an axial stress in the thrust bearing 53. The axial stress is then transmitted into the drive gear 11 and because of the helical formation of the teeth on the drive gear this is translated into rotational movement of the plate cylinder.

It should be recognized that the sources of motive power 16 can be connected to appropriate press controls which may be remote from the site of operation. Through this mechanism it is possible for an operator to be located at a console some distance away from the operative mechanisms themselves and still be able to make adjustments as required in both the lateral and circumferential register of the plate roll.

It is to be understood that the foregoing description is by way of example only and is not intended to impose limitations upon the present invention since numerous modifications or changes will readily occur to those skilled in the art.

What is claimed is:

1. In a rotary printing press having a set of side frame, a plate cylinder with journals for rotatably supporting the plate cylinder in said frames and a plate cylinder helical drive gear mounted on one of the journals to effect rotation of the plate cylinder, a lateral and circumferential register adjusting mechanism comprising:

(a) elongated operator means having external threads on the outer surface thereof supported at a first end within a bore formed in the plate cylinder journal carrying the cylinder drive gear for relative rotation with respect to the journal and supported on a second end within first internally threaded means fixed with respect to a press side frame;

(b) first drive means operably connected to said operator means to effect rotation and simultaneous longitudinal movement thereof, whereby lateral movement of the plate cylinder is effected and adjustment of lateral register is accomplished;

(c) second internally threaded means disposed on and mating with the external threads on the outer surface of said elongated operator means;

(d) means operably connecting said internally threaded means to the plate cylinder drive gear; and (e) second drive means operably connected to said second internally threaded means to effect rotation thereof, which rotation creates lateral forces in the plate cylinder drive gear that causes rotation thereof and effects adjustment of circumferential register.

2. A register adjusting mechanism as defined in claim 1 wherein said elongated operator means comprises:

(a) an elongated shaft having external threads on the outer surface thereof;

(b) a shoulder on said first end thereof to receive a bearing which supports said first end within the bore formed in the plate cylinder journal; and (c) a shoulder on said second end thereof to receive said means operably connecting said first drive means to said elongated shaft.

3. A register adjusting mechanism as defined in claim 1 wherein said first drive means is a linear motor.

4. A register adjusting mechanism as defined in claim 1 wherein:

(a) said first drive means is a linear motor having a reciprocating rack; and (b) said means operably connecting said first drive means to said elongated operator means is a toothed wheel that mates with said rack.

5. A register adjusting mechanism as defined in claim 1 wherein:

(a) said second internally threaded means is a sleeve having (i) means on the outer surface thereof adjacent that end away from the plate cylinder drive gear whereby rotation of said sleeve can be effected; and (ii) a shoulder adjacent the other end thereof, (b) bearing means mounted on said shoulder; and (c) means connecting said bearing means to the plate cylinder drive gear.

6. A register adjusting mechanism as defined in claim 2 wherein said bearing which supports said elongated shaft within the bore in a plate cylinder journal is a thrust bearing, whereby rotation of said elongated operator means causes axial adjustment in the position of the plate cylinder.

* * * * *